US009683422B2

(12) United States Patent
Boyd

(10) Patent No.: US 9,683,422 B2
(45) Date of Patent: Jun. 20, 2017

(54) ROTATING FLOW CONTROL DIVERTER HAVING DUAL STRIPPER ELEMENTS

(71) Applicant: WEATHERFORD TECHNOLOGY HOLDINGS, LLC, Houston, TX (US)

(72) Inventor: Michael Boyd, Nisku (CA)

(73) Assignee: Weatherford Technology Holdings, LLC, Houston, TX (US)

( * ) Notice: Subject to any disclaimer, the term of this patent is extended or adjusted under 35 U.S.C. 154(b) by 281 days.

(21) Appl. No.: 14/406,650

(22) PCT Filed: Jun. 12, 2013

(86) PCT No.: PCT/CA2013/050444
§ 371 (c)(1),
(2) Date: Dec. 9, 2014

(87) PCT Pub. No.: WO2013/185227
PCT Pub. Date: Dec. 19, 2013

(65) Prior Publication Data

US 2015/0159460 A1 Jun. 11, 2015

Related U.S. Application Data

(60) Provisional application No. 61/658,680, filed on Jun. 12, 2012.

(51) Int. Cl.
*E21B 33/068* (2006.01)
*E21B 33/08* (2006.01)
(Continued)

(52) U.S. Cl.
CPC ..... *E21B 33/068* (2013.01); *E21B 21/08* (2013.01); *E21B 33/085* (2013.01); *E21B 34/02* (2013.01)

(58) Field of Classification Search
CPC ..... E21B 33/085
See application file for complete search history.

(56) References Cited

U.S. PATENT DOCUMENTS 1,902,906 A 3/1933 Seamark
2,222,082 A 11/1940 Leman et al.
(Continued)

FOREIGN PATENT DOCUMENTS

CA 2801788 12/2011
CA 2751179 2/2012
(Continued)

OTHER PUBLICATIONS

FEA Consulting; Getting a Grip on Oil Well Pressure With DesignSpace; Ohio CAE; www.ohiocae.com; pp. 1-4.
(Continued)

*Primary Examiner* — George Gray
(74) *Attorney, Agent, or Firm* — Smith IP Services, P.C.

(57) ABSTRACT

A rotating flow control diverter apparatus having an upper and a lower stripper element mounted on upper and lower tubular shaft, respectively, each of which is axially rotatable by means of an upper and lower sealed bearing assembly, respectively, within a central bore of a housing. An upper and lower seal assembly seal the annular space between the central bore and the upper and lower tubular shaft, respectively to define a purge chamber. The purge chamber is in fluid communication with the central bore via the lower tubular shaft, and may be provided with valved ports. The housing may be constructed in removably mounted upper and lower portions, to which the upper and lower sealed bearing assemblies, respectively, and upper and lower seal assemblies, respectively, are mounted.

7 Claims, 1 Drawing Sheet

(51) Int. Cl.
*E21B 21/08* (2006.01)
*E21B 34/02* (2006.01)

(56) References Cited

U.S. PATENT DOCUMENTS

| | | | | |
|---|---|---|---|---|
| 3,387,851 | A | 6/1968 | Cugini | |
| 3,561,723 | A | 2/1971 | Cugini | |
| 4,143,881 | A | 3/1979 | Bunting | |
| 4,383,577 | A | 5/1983 | Pruitt | |
| 4,406,333 | A | 9/1983 | Adams | |
| 4,531,580 | A | 7/1985 | Jones | |
| 4,754,820 | A | 7/1988 | Watts et al. | |
| 4,832,126 | A | 5/1989 | Roche | |
| 5,213,158 | A | 5/1993 | Bailey et al. | |
| 5,305,839 | A | 4/1994 | Kaisi et al. | |
| 5,647,444 | A * | 7/1997 | Williams | E21B 33/085 166/84.1 |
| 5,662,181 | A | 9/1997 | Williams et al. | |
| 6,129,152 | A | 10/2000 | Hosie et al. | |
| 6,230,824 | B1 * | 5/2001 | Peterman | E21B 21/001 166/359 |
| 6,244,359 | B1 | 6/2001 | Bridges et al. | |
| 6,443,240 | B1 | 9/2002 | Scott | |
| 6,470,975 | B1 | 10/2002 | Bourgoyne et al. | |
| 6,547,002 | B1 | 4/2003 | Bailey et al. | |
| 2003/0106712 | A1 | 6/2003 | Bourgoyne et al. | |
| 2004/0084220 | A1 | 5/2004 | Bailey et al. | |
| 2005/0000698 | A1 | 1/2005 | Bailey et al. | |
| 2005/0241833 | A1 * | 11/2005 | Bailey | E21B 33/085 166/379 |
| 2006/0102387 | A1 | 5/2006 | Bourgoyne et al. | |
| 2008/0105434 | A1 | 5/2008 | Orbell et al. | |
| 2009/0101351 | A1 | 4/2009 | Hannegan | |
| 2009/0101411 | A1 | 4/2009 | Hannegan et al. | |
| 2009/0139724 | A1 | 6/2009 | Gray et al. | |
| 2009/0161997 | A1 | 6/2009 | Beauchamp et al. | |
| 2010/0175882 | A1 | 7/2010 | Bailey et al. | |
| 2011/0024195 | A1 | 2/2011 | Hoyer et al. | |
| 2011/0278014 | A1 | 11/2011 | Hughes et al. | |
| 2011/0315404 | A1 | 12/2011 | Bailey et al. | |
| 2012/0055677 | A1 | 3/2012 | Boyd | |
| 2013/0020068 | A1 | 1/2013 | Boyd | |
| 2013/0233556 | A1 | 9/2013 | Boyd | |
| 2014/0238686 | A1 | 8/2014 | Boyd | |
| 2014/0318768 | A1 | 10/2014 | Boyd | |
| 2014/0318772 | A1 | 10/2014 | Boyd | |
| 2015/0007979 | A1 | 1/2015 | Boyd | |
| 2015/0021045 | A1 | 1/2015 | Boyd | |

FOREIGN PATENT DOCUMENTS

| | | |
|---|---|---|
| CA | 2783442 | 7/2012 |
| CA | 2841609 | 7/2012 |
| CA | 2856071 | 9/2012 |
| CA | 2876067 | 6/2013 |
| EP | 1659260 | 5/2006 |
| EP | 2053197 | 4/2009 |
| WO | 9949173 | 9/1999 |
| WO | 0179654 | 10/2001 |
| WO | 2011153621 | 12/2011 |
| WO | 2013037049 | 9/2012 |
| WO | 2013037049 | 3/2013 |
| WO | 2013097034 | 7/2013 |

OTHER PUBLICATIONS

Schlumberger; Oilfield Glossary; Riser; www.glossary.oilfield.slb.com; Jun. 27, 2011.

Schlumberger; Oilfield Glossary; www.glossary.oilfield.slb.com; Jun. 27, 2011.

Outline of Riser Drilling; www.jamstec.go.jp; Newsletter vol. 15; Jun. 27, 2011.

Hannigan, D.; Rotating Control Heads the When and Why; Journal of Canadian Petroleum Technology; pp. 6-8.

Strata Energy Services Inc.; RFD Series; Rotating Flow Diverters; www.strataenergy.net; 4 pages.

* cited by examiner

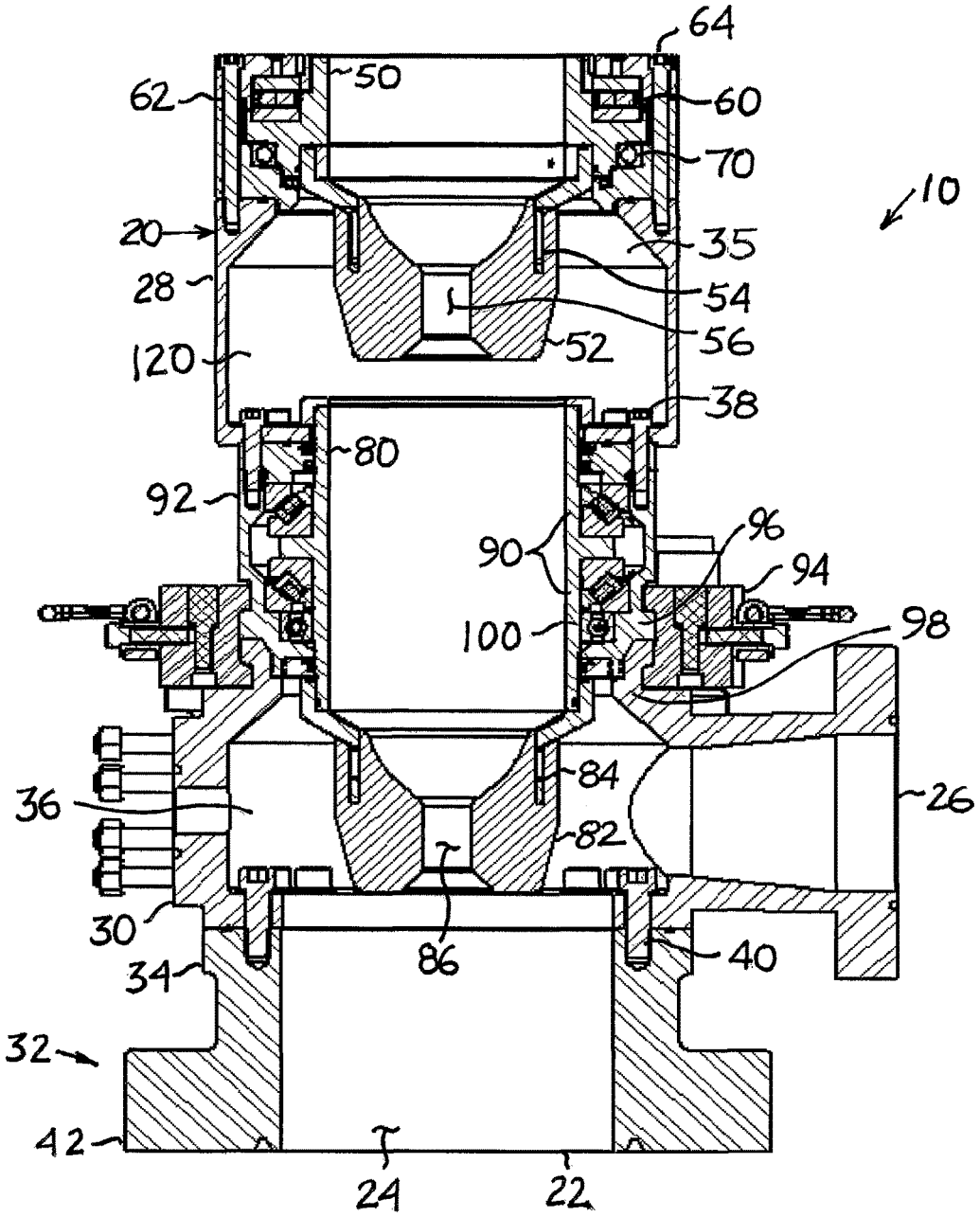
64
50
62
60
70
10
20
35
28
54
56
52
120
38
80
92
96
90
94
100
98
84
36
26
82
30
86
40
34
32
42
24
22

ROTATING FLOW CONTROL DIVERTER HAVING DUAL STRIPPER ELEMENTS

CROSS REFERENCE TO RELATED APPLICATIONS

The application claims the priority benefit of U.S. Provisional Application No. 61/658,680 filed on Jun. 12, 2012, entitled "Rotating Flow Control Device Having Dual Stripper Elements", the entire contents of which are incorporated herein by reference, where permitted.

FIELD OF THE INVENTION

The invention relates to a wellhead apparatus for well control, and more particularly to an apparatus used to control and divert well fluids during drilling and other operations.

BACKGROUND

In a drilling rig for oil, gas or coal bed methane, it is conventional to mount a rotating flow control diverter (RFCD) at the top of a blowout preventer (BOP) stack beneath the drilling floor of the drilling rig. The rotating flow control diverter prevents the unintentional escape of well fluids (such as drilling mud, produced fluids and gases, and surface-injected air or gas into a recovery line) by containing and diverting them from the wellbore annulus away from the rig floor. At the same time, the rotating flow control diverter allows a drill string to be passed into and out of the wellbore, and rotated within the wellbore. A typical rotating flow control diverter comprises a stationary housing adapted for incorporation into a wellhead and a rotating tubular shaft with a rubber sealing element to establish a seal with a tubular such as tubing or drill pipe that is passed through the tubular shaft. The tubular shaft is rotatably and axially supported in the stationary housing by an internal bearing assembly comprising bearings and a seal assembly for isolating the bearings from well fluids. The bearing assembly typically comprises an inner race fixed to the outer surface of the tubular shaft, and an outer race fixed to the inner surface of the housing. In use, the tubular, the tubular shaft and sealing element rotate together within the housing.

It is known in the industry to mount a second or upper stripper element (commonly known in the industry as the "dual stripper") on top of a rotating flow control diverter to enhance the control of wellbore fluids and gases and to provide an additional safeguard against the unintentional escape of wellbore fluids and gases, in the event that the main stripper element of the rotating flow control diverter fails. Prior art rotating flow control diverters with dual strippers typically have both stripper elements attached to a common tubular shaft running through the rotating flow control diverter. Accordingly, if the bearing assembly supporting that tubular shaft fails, then both of the stripper elements may cease to rotate freely within the housing. If the drill string continues to rotate, then the friction between the drill string and the stripper elements will wear and damage the stripper elements, and possibly cause them to fail. Furthermore, prior art rotating fluid control diverters with dual strippers are typically ill equipped to deal with the treatment and removal of gaseous and liquid substances trapped between the two stripper elements.

There is need in the art for an improved rotating control flow diverter with dual strippers that is relatively simple and robust.

SUMMARY OF THE INVENTION

The present invention is directed to a rotating flow control diverter apparatus having dual stripper elements. The apparatus comprises a stationary housing, an upper and a lower tubular shaft, an upper and a lower sealed bearing assembly, and an upper and a lower seal assembly. The stationary housing defines an inlet for well fluid adapted for connection to the wellhead or the blowout preventer, a central bore in fluid communication with the inlet, and at least one outlet for well fluid in communication with the central bore. The upper stripper element is attached to the upper tubular shaft. In use, the upper stripper element establishes a seal between the upper tubular shaft and an outside surface of the tubular passing axially through the upper tubular shaft. The upper sealed bearing assembly is mounted to the housing and supports the upper tubular shaft for axial rotation within the central bore. The upper seal assembly seals an annular space defined between the central bore and an outside surface of the upper tubular shaft. The lower tubular shaft is in substantial axial alignment with the upper tubular shaft. The lower stripper element is attached to the lower tubular shaft. In use, the lower stripper element establishes a seal between the lower tubular shaft and an outside surface of the tubular passing axially through the lower tubular shaft. The lower sealed bearing assembly is mounted to the housing and supports the lower tubular shaft for axial rotation within the central bore. The lower seal assembly seals an annular space defined between the central bore and an outside surface of the lower tubular shaft.

In one embodiment of the apparatus, the upper seal assembly, lower seal assembly, and a portion of the central bore therebetween, define a purge chamber in fluid communication with the central bore below the lower seal assembly via the lower tubular shaft. In one embodiment of the apparatus, the housing may comprise at least one valved port with the purge chamber. In one embodiment of the apparatus, the apparatus may further comprise a means for monitoring fluid or gas pressure within the purge chamber.

In one embodiment of the apparatus, the housing comprises an upper portion of the housing a lower portion of the housing and a fastener. The upper portion of the housing defines an upper portion of the central bore. The upper sealed bearing assembly is mounted to the upper portion of the housing and supports the upper tubular shaft for axial rotation within the upper portion of the central bore. The lower portion of the housing defines the inlet and a lower portion of the central bore. The lower sealed bearing assembly is mounted to the lower portion of the housing and supports the lower tubular shaft for axial rotation within the lower portion of the central bore. The fastener removably secures the upper portion of the housing to the lower portion of the housing. When the upper portion of the housing is secured to the lower portion of the housing by the fastener, the upper portion of the central bore is axially aligned with the lower portion of the central bore, and the upper tubular shaft is axially aligned with the lower tubular shaft. In one embodiment of the apparatus, the upper portion of the housing may comprise a removably attachable sub-assembly to which the upper sealed bearing assembly and upper seal assembly is mounted. In one embodiment of the apparatus, the lower portion of the housing may comprise a removably attachable sub-assembly to which the lower sealed bearing assembly and lower seal assembly is mounted.

BRIEF DESCRIPTION OF THE DRAWINGS

In the drawing, like elements are assigned like reference numerals. The drawing is not necessarily to scale, with the emphasis instead placed upon the principles of the present invention. Additionally, each of the embodiments depicted are but one of a number of possible arrangements utilizing the fundamental concepts of the present invention.

The drawing comprises a cross-sectional side view of one embodiment of a rotating flow control diverter apparatus of the present invention.

DETAILED DESCRIPTION OF PREFERRED EMBODIMENTS

The invention relates to a rotating flow control diverter having dual stripper elements. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

As used herein, the term "well fluid" shall refer any liquid or gas, or combination thereof, that may emanate from a wellbore of an oil or gas well. Without limiting the generality of the foregoing, well fluids may include formation liquid or gas produced by the well, drilling fluid, and any gas that may be injected into the wellbore at the surface.

The present apparatus is directed to a rotating flow control diverter (10) having dual stripper elements, one embodiment of which is shown in the drawing. In general, the apparatus (10) comprises a housing (20), an upper tubular shaft (50), an upper stripper element (52), an upper sealed bearing assembly (60), an upper seal assembly (70), a lower tubular shaft (80), a lower stripper element (82), a lower sealed bearing assembly (90), and a lower seal assembly (100).

The housing (20) defines an inlet for well fluid (22) that is adapted for connection to the top of a wellhead or a blowout preventer stack. The housing (20) defines a central bore (24) in fluid communication with the inlet (22). The housing (20) further defines at least one outlet for well fluid (26) in communication with the central bore (24). The housing (20) may be made of any material that is sufficiently strong to withstand the operational pressures of well fluid to be expected within the housing; such materials may include, without limitation, 41/30 alloy steel.

In one embodiment not shown, the entirety of the housing (20) may be monolithically constructed, and may include a flanged connection for connection to other wellhead components such as a blow out preventer.

In one embodiment as shown in FIG. 1 the drawing, the housing (20) comprises an upper portion of the housing (28), a lower portion of the housing (30) and a flanged connection (32). The upper portion of the housing (28) and the lower portion of the housing (30) define an upper portion of the central bore (35) and a lower portion of the central bore (36), respectively. The upper portion of the housing (28) is removably attached to the lower portion of the housing (30) with a fastener, such as but not limited to bolts (38) passing through bolt holes tapped into the body of the lower portion of the housing (28). The lower portion of the housing (30) is removably attached to the flanged connection (32) with a fastener, such as but not limited to bolts (40) passing through the bolt holes tapped into the body of the flanged connection (32). Gaskets or a-ring seals (not shown) may be provided between the upper portion of the housing (28) and the lower portion of the housing (30), and between the lower portion of the housing (30) and the flanged connection (32) to provide a fluid-tight seal between the interfacing parts. In the embodiment shown in the drawing, the flanged connection (32) is a double flanged steel spool. The upper flange (34) of the spool is adapted to mate with the bottom end of the lower portion of the housing (30). As such, the upper flange (34) should be selected to match the working pressure, custom profile and integrity of the lower portion of the housing (30). The integrally machined lower flange (42) of the spool is adapted to mate with the top of a wellhead or the blowout preventer. In one embodiment, the lower flange (42) may conform to a standard flange specification of the American Petroleum Institute (API). For example, the lower flange (42) may be a 135/8" 5000 PSI API flange. The use of such a double flanged spool, allows the lower portion of the housing (30) to be a standardized component that can adapted to receive well fluid from a variety of different wellheads or blowout preventer stacks.

The upper tubular shaft (50) is proportioned to allow a tubular (such as a drill string) to pass through in the axial direction. The upper tubular shaft (50) has an attached upper stripper element (52) that, in use, establishes a fluid-tight seal between the upper tubular shaft (50) and the outer surface of a tubular passing through it. The upper tubular shaft (50) may be made of any suitably strong and rigid material such as alloy steel, and the upper stripper element (52) may be made of an elastomeric material.

In one embodiment as shown in the drawing, the upper stripper element (52) is attached to the lower end of the upper tubular shaft (50) by means of an insert (54) attached to the outer surface of upper tubular shaft (50) and extending into the body of the upper stripper element (52). The upper stripper element (52) has a frustum shape with the narrow end oriented downwards. The upper stripper element (52) defines a passage (56) having a diameter that is slightly smaller than the outer diameter of a tubular to be passed through upper tubular shaft (50). The foregoing description of one embodiment of the upper stripper element (52) and the manner of its attachment to the upper tubular shaft (50) is not intended to be limiting of the claimed invention, and one skilled in the art will recognize that any suitable stripper elements may be employed with the apparatus (10).

The upper sealed bearing assembly (60) supports the upper tubular shaft (50) for axial rotation within the central bore (24). One skilled in the art will recognize that any suitable sealed bearing assembly may be employed as the upper bearing assembly (60) in the apparatus (10).

In one embodiment as shown in the drawing, the upper sealed bearing assembly (60) is mounted within a removably attachable sub-assembly (62) of the housing (20). The sub-assembly is removably secured to remaining portion of the housing (20) with a fastener, such as but not limited to bolts (64) passing through bolt holes formed in the body of the housing (20).

The upper seal assembly (70) seals the annular space between the central bore (24) and the outside surface of the upper tubular shaft (50), thereby preventing well fluid from passing between these two parts. In one embodiment as shown in the drawing, the upper seal assembly (70) is provided in the form of an O-ring which is installed as part of the sub-assembly (62) of the housing (20) that supports the upper sealed bearing assembly (60). One skilled in the art will appreciate that the upper seal assembly (70) may be implemented by other suitable means known in the art.

The lower tubular shaft (80) is proportioned to allow a tubular (such as a drill string) to pass through in the axial direction, and is axially aligned with the upper tubular shaft (50). The lower tubular shaft (80) has an attached lower stripper element (20) that, in use, establishes a fluid-tight seal between the lower tubular shaft (80) and the outer surface of a tubular passing through it. The lower tubular shaft (80) may be made of any suitably strong and rigid material such as alloy steel, and the lower stripper element (82) may be made of an elastomeric material.

In one embodiment as shown in the drawing, the lower stripper element (82) is attached to the lower end of the lower tubular shaft (80) by means of an insert (84) attached to the outer surface of lower tubular shaft (80) and extending into the body of the lower stripper element (82). The lower stripper element (82) may be different, similar or identical to the upper stripper element (52).

The lower sealed bearing assembly (90) supports the lower tubular shaft (80) for axial rotation within the central bore (24) of the housing. One skilled in the art will recognize that any suitable sealed bearing assembly may be employed as the lower bearing assembly (90) in the apparatus (10).

In one embodiment as shown in the drawing, the lower sealed bearing assembly (90) is mounted within a removably attached sub-assembly (92) of the lower portion of the housing (20). The sub-assembly (92) is removably secured to the remaining portion of the housing (20) by a fastener, such as but not limited to a clamp (94) that binds a flange (96) on the lower end of the sub-assembly against a complementary flange (98) on the upper end of the lower portion of the housing (20). In one embodiment, the clamp (94) is a solid locking ring clamp with complementary locking tabs. The clamp (94) may be either manually or hydraulically actuated.

The lower seal assembly (100) seals the annular space between the central bore (24) and the outside surface of the lower tubular shaft (80), thereby preventing well fluid from passing between these two parts. In one embodiment as shown in the drawing, the lower seal assembly (100) is provided in the form of an O-ring which is installed as part of the sub-assembly (92) of the housing (20) that supports the lower sealed bearing assembly (90). One skilled in the art will appreciate that the lower seal assembly (100) may be implemented by other suitable means known in the art.

In one embodiment as shown in the drawing, the apparatus (10) has a purge chamber (120) defined by a section of the central bore (24) between the upper seal assembly (70) and the lower seal assembly (100). The purge chamber (120) is in fluid communication with the portion of the central bore (24) below the lower seals assembly (100) via the lower tubular shaft (80). In one embodiment, the housing (20) may define at least one valved port (not shown) in fluid communication with the purge chamber (120). In one embodiment, the apparatus (10) may further comprise a means for monitoring fluid pressure (not shown) within the purge chamber (120) such as a pressure gauge or a pressure-sensitive transducer.

The apparatus (10) of the present invention may be used for well control operations, to promote rig safety, to reduce the risk of environmental contamination, for underbalanced drilling operations, for managed pressure drilling operations and with conventional drilling operations.

The use and operation of the apparatus (10) in the embodiment shown in the drawing is now described by way of a non-limiting example. The apparatus (10) is installed on the top of a blowout preventer stack by bolts passing through bolt holes (not shown) in the lower flange (42) of the flanged connection (32). The removable attachment of the upper portion of the housing (28) to the lower portion of the housing (30), and the removable attachment of the lower portion of the housing (30) to the flanged connection (32) allows the apparatus (10) to be installed either selectively in stages, or as a single pre-assembled unit, and to be selectively dismantled in stages such as for servicing internal components.

A tubular is inserted downwardly through the upper tubular shaft (50) and subsequently through the lower tubular shaft (80). As the diameter of the passage (56) of the upper stripper element (52) and the passage (86) of the lower stripper element (82) are slightly smaller than the outer diameter of the tubular inserted, the upper stripper element (52) and the lower stripper element (82) will stretch fit around the tubular, providing a seal around the tubular.

It will be appreciated that if a torque is applied to the tubular about its axial direction, the friction between the upper and lower stripper elements (52, 82) and the tubular will be sufficient to transfer the torque to the upper and lower tubular shafts (50, 80), respectively. In turn, the upper and lower tubular shafts (50, 80) will rotate within the housing (20), as permitted by the upper and lower sealed bearing assemblies (60, 90). The provision of two distinct and independent sealed bearing assemblies (60, 90) for each of the tubular shafts (50, 80) is advantageous in that the failure of either one of the sealed bearing assemblies (60, 90) prevents only one, and not both, of the tubular shafts (50, 80) from rotating. The stripper element (52, 82) that is attached to the still rotatable tubular shaft (50, 80) is thereby protected from excessive wear or damage if the tubular continues to rotate.

Well fluid flowing upwardly through the top of the blowout preventer flows through the inlet (22) into the lower portion of the central bore (24). The pressure of the well fluid acts upwardly on the lower, narrow end of the frustum-shaped lower stripping element (82), thereby urging it into further sealing relationship with the tubular. The lower seal assembly (100) prevents the well fluid from flowing further upwards within the central bore, thereby containing the well fluid. The outlet (26) may be selectively opened to divert the upward flowing well fluid away from the rig floor, through an alternative flow line.

Under normal operating conditions, the lower stripper element (82) prevents the upwardly flowing well fluid from flowing upwardly through the lower tubular shaft (80). If, however, the pressure of the upward flow well fluid is sufficiently high, or if either the lower stripper element (82) or the lower seal assembly (100) becomes worn or damaged, them the well fluid may leak either between the lower stripper element (82) and the tubular passing through the inside of the lower tubular shaft (80), or between the lower portion of the housing (30) and the outside surface lower tubular shaft (80), and upwards into the purge chamber (120).

If a fluid pressure monitor or sensor in the purge chamber (120) is provided, an operator may use this information to monitor the wear of the lower stripper element (82) and the lower seal assembly (100) and, thus forecast a failure either of these seals before a failure occurs, and schedule suitable maintenance or repair procedures.

If valved ports in fluid communication with the purge chamber (120) are provided, the operator may use the valved ports to introduce any suitable inert gas into one of the valved ports while allowing trapped well fluids to escape from the purge chamber through another valved port. For example, in sour gas drilling, small amounts of sour gases and liquids may be trapped in tool joint grooves of the tubular as it passes through the lower stripper element (82). Inert gas such as nitrogen can be introduced into the purge chamber using one of the valved ports, while allowing sour gases to vent out of the purge chamber through another valved port. The vented sour gases can be captured and diverted from the rig floor.

As will be apparent to those skilled in the art, various modifications, adaptations and variations of the foregoing specific disclosure can be made without departing from the scope of the invention claimed herein.

What is claimed is:

1. A rotating flow control diverter apparatus, the apparatus comprising:

an upper tubular shaft;

an upper stripper element attached to the upper tubular shaft;

an upper bearing assembly which supports the upper tubular shaft and permits axial rotation of the upper tubular shaft;

a lower tubular shaft which is axially aligned with the upper tubular shaft;

a lower stripper element attached to the lower tubular shaft; and a lower bearing assembly which supports the lower tubular shaft and permits axial rotation of the lower tubular shaft independent of the upper tubular shaft.

2. The apparatus of claim 1, further comprising:

a stationary housing, wherein the stationary housing comprises an inlet through which well fluid enters the rotating control diverter apparatus, wherein the stationary housing further comprises at least one outlet through which the well fluid exits the rotating control diverter apparatus, and wherein the upper bearing assembly and the lower bearing assembly are mounted in the stationary housing.

3. The apparatus of claim 2, wherein an upper portion of the stationary housing comprises a first removable sub-assembly to which the upper bearing assembly is mounted, and wherein a lower portion of the stationary housing comprises a second removable sub-assembly to which the lower bearing assembly is mounted.

4. The apparatus of claim 2, further comprising:

an upper seal assembly which forms a first seal between the stationary housing and an outside surface of the upper tubular shaft; and a lower seal assembly which forms a second seal between the stationary housing and an outside surface of the lower tubular shaft.

5. The apparatus of claim 4, further comprising:

a purge chamber defined by the upper seal assembly and the lower seal assembly.

6. The apparatus of claim 5, wherein a portion of the well fluid trapped within the purge chamber is vented from the purge chamber by an inert gas introduced into the purge chamber.

7. The apparatus of claim 5, wherein wear of the lower stripper element and the lower seal assembly corresponds to monitored pressure in the purge chamber.

* * * * *